US008720585B2

(12) United States Patent
Mothaffar

(10) Patent No.: US 8,720,585 B2
(45) Date of Patent: May 13, 2014

(54) DEEP-WATER OIL WELL SPILL CONTROLLER AND CONTAINER

(76) Inventor: Hussain Y. A. M. Mothaffar, Al-Rawda (KW)

( * ) Notice: Subject to any disclaimer, the term of this patent is extended or adjusted under 35 U.S.C. 154(b) by 291 days.

(21) Appl. No.: 13/103,346

(22) Filed: May 9, 2011

(65) Prior Publication Data

US 2012/0285704 A1 Nov. 15, 2012

(51) Int. Cl.
*E21B 33/12* (2006.01)

(52) U.S. Cl.
CPC ..... *E21B 33/12* (2013.01)
USPC ..... 166/363; 166/96.1; 166/192; 405/60

(58) Field of Classification Search
CPC ..... E21B 23/00; E21B 33/035; E21B 33/043; E21B 33/12; E21B 33/13; E02D 5/38
USPC ..... 166/363, 339, 344, 351, 364, 285, 79.1, 166/81.1, 96.1, 97.1, 75.13, 177.4, 85.4, 166/192; 405/60, 224, 225, 233, 244, 256, 405/228
See application file for complete search history.

(56) References Cited

U.S. PATENT DOCUMENTS

| | | | | |
|---|---|---|---|---|
| 1,807,498 | A * | 5/1931 | Teed | 166/95.1 |
| 1,822,141 | A * | 9/1931 | Gallaher | 166/92.1 |
| 1,858,241 | A * | 5/1932 | Giles | 166/95.1 |
| 1,894,912 | A | 1/1933 | Otis | |
| 2,092,041 | A * | 9/1937 | Armentrout et al. | 166/100 |
| 3,247,672 | A * | 4/1966 | Johnson | 405/210 |
| 4,220,421 | A * | 9/1980 | Thorne | 405/211 |
| 4,461,354 | A * | 7/1984 | Buras et al. | 166/343 |
| 4,531,583 | A | 7/1985 | Revett | |
| 5,150,752 | A * | 9/1992 | Gunst et al. | 166/97.1 |
| 5,205,358 | A * | 4/1993 | Mitzlaff | 166/187 |
| 5,213,157 | A * | 5/1993 | Wills | 166/79.1 |
| 5,361,840 | A * | 11/1994 | Matthews | 166/285 |
| 5,372,198 | A * | 12/1994 | North et al. | 166/363 |
| 6,009,944 | A | 1/2000 | Gudmestad | |
| 6,189,620 | B1 * | 2/2001 | McDowell | 166/379 |
| 6,488,094 | B1 * | 12/2002 | McDowell | 166/379 |
| 6,595,289 | B2 * | 7/2003 | Tumlin et al. | 166/286 |
| 6,923,263 | B2 | 8/2005 | Eden et al. | |
| 7,290,603 | B2 | 11/2007 | Hiorth et al. | |
| 7,341,109 | B1 * | 3/2008 | McDowell | 166/379 |
| 7,513,309 | B2 * | 4/2009 | Ruttley et al. | 166/341 |
| 8,205,677 | B1 * | 6/2012 | Salkin | 166/363 |
| 8,215,405 | B1 * | 7/2012 | Carrascal | 166/363 |
| 8,322,437 | B2 * | 12/2012 | Brey | 166/363 |
| 2010/0294486 | A1 * | 11/2010 | Pallini et al. | 166/206 |
| 2011/0274493 | A1 * | 11/2011 | Cutts | 405/60 |
| 2011/0290501 | A1 * | 12/2011 | Duncan et al. | 166/363 |
| 2011/0299930 | A1 * | 12/2011 | Messina | 405/60 |
| 2011/0303416 | A1 * | 12/2011 | Herman, II | 166/350 |
| 2011/0315393 | A1 * | 12/2011 | Wolinsky | 166/363 |
| 2012/0012329 | A1 * | 1/2012 | Klapyk et al. | 166/363 |
| 2012/0018174 | A1 * | 1/2012 | Kotefski et al. | 166/386 |
| 2012/0055573 | A1 * | 3/2012 | Adams | 138/89 |

* cited by examiner

*Primary Examiner* — Matthew Buck
(74) *Attorney, Agent, or Firm* — Lowe Hauptman & Ham, LLP

(57) ABSTRACT

The present invention provides a deep-water oil well plug apparatus having a plunger member on an elongate shaft and a plurality of inflatable members configured and shapes to seal within the well bore, and a bell-shaped chamber placed on top of the oil well and adapted to be filled with concrete, and a hydraulic mechanism to remove and release the bell-shaped chamber from the oil well.

5 Claims, 8 Drawing Sheets

DEEP-WATER OIL WELL SPILL CONTROLLER AND CONTAINER

TECHNICAL FIELD

The present invention is generally directed toward a method and apparatus for plugging an oil well bore, and more particularly, to an apparatus for inserting a plug into the well bore and then creating a cement chamber on the top of the oil well.

BACKGROUND OF THE INVENTION

Deep-water and deep-water oil wells are positioned in a very harsh environment for divers to reach and work. In order to contain an oil spill from a deep-water well, access to the well is crucial in a timely manner and thereafter the spill will allow the normally used top kill procedure to succeed.

Many prior art oil well plugs and containment systems have been developed in recent years. Although the plugs and systems tend to seal the oil well, the prior art apparatus and systems have shortcomings in containing deep-water oil spills and plugging deep-water wells.

For example, U.S. Pat. No. 1,894,912, issued to Otis, discloses a process for inserting tubing in wells with high pressures of the fluid in the wells through a perforated tubing.

Another approach is disclosed in U.S. Pat. No. 6,009,944, issued to Gudmestad, which discloses a plug-launching device for cementing operations in of and gas wells with plugs forced into position by cement.

Yet a further recent approach is disclosed in U.S. Pat. No. 6,595,289, to Tumlin, in which a method and apparatus for plugging a well bore is disclosed using a radial expander securing the setting tool with lowered assembly with circular charges for perforating casing 15 and forming perforations with cement pumped in to seal the outside of the wellbore.

One of the disadvantages associated with these prior art well bore sealing plugs and apparatus is the shortcoming of their designs to operate in deep-water environments.

It is therefore a primary object of the present invention to provide a deep-water oil well seal and plug apparatus which can plug the oil pipe bore at first, and at second create a concrete casing for permanently sealing and abandoning the oil well.

Notwithstanding the above, it is presently believed that there may be a significant demand in the marketplace for a deep-water oil well plug and seal having the above-stated features of the present invention that can be used in an environment of deep-water pressure, extreme low temperatures, and extreme oil flow gushing out of a damaged riser.

BRIEF SUMMARY OF THE INVENTION

These problems and others are addressed by the present invention which comprises a deep-water oil well plug apparatus having a plunger member on an elongate shaft and a plurality of inflatable members configured and shapes to seal within the well bore, and a bell-shaped chamber placed on top of the oil well and adapted to be filled with concrete, and a hydraulic mechanism to remove and release the bell-shaped chamber from the oil well.

BRIEF DESCRIPTION OF THE DRAWINGS

These and other objects of the present invention will be appreciated and understood by those skilled in the art from the detailed description of the preferred embodiments of the invention and the following drawings of which.

DETAILED DESCRIPTION OF THE INVENTION

Figure 1:
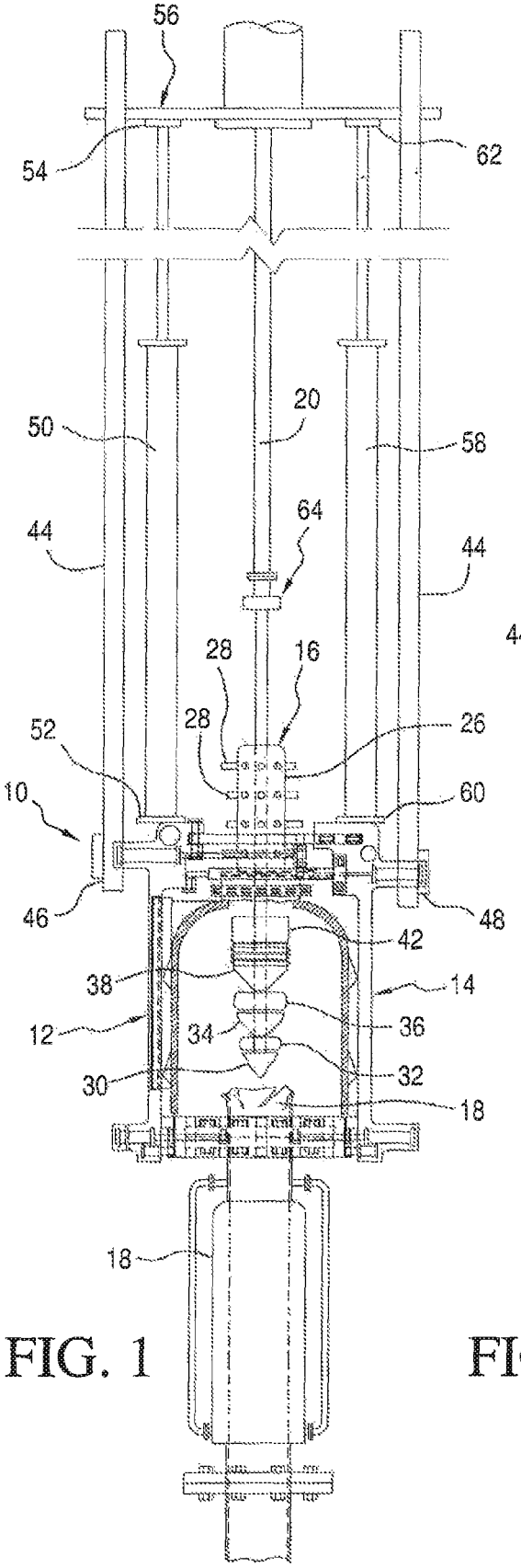
FIG. 1 is a partly side elevation and partly side sectional view of an oil well plug apparatus in a pre-seal configuration attached to the oil well riser in accordance with a preferred embodiment of the present invention.

For the purpose of promoting and understanding of the principles of the invention, reference will now be made to the embodiments illustrated in the drawings. Referring now to the drawings, and more specifically to FIGS. 1 through 6, wherein the showings are for the purpose of illustrating the preferred embodiment of the invention only and not for the purpose of limiting the same, an oil well plug apparatus is generally illustrated at 10 having a first main frame 12 and a complimentary and symmetrical second main frame 14, both of which preferably made from material such as, but not limited to, steel or heavy-duty composites, which will be explained herein in greater detail, and will carry other components that will form a bell-shaped concrete chamber block as well supporting a plunger.

The oil well plug apparatus 10 further includes a plunger member 16, which as will be explained in greater detail herein, it is designed to be inserted inside an oil well pipe or pipe riser 18 to temporarily or permanently block a major portion or all of the oil gushing out of the well, and additionally or alternatively, to allow to create the concrete chamber block.

Figure 5:
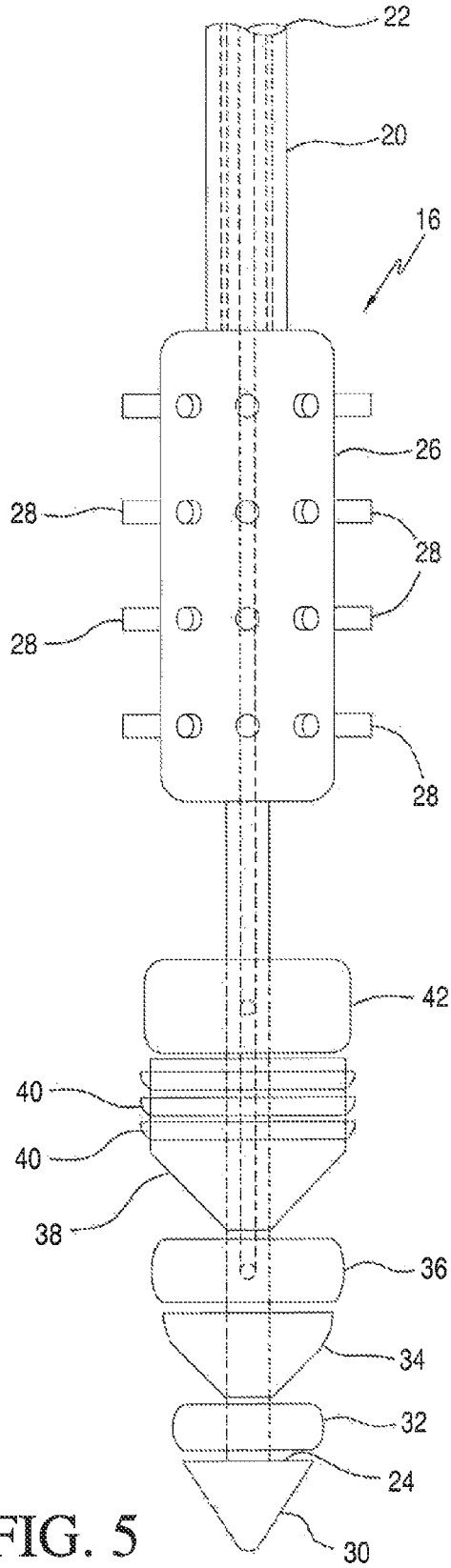
FIG. 5 is a side elevation view of an oil well plunger in accordance with a preferred embodiment of the present invention.

Referring now more specifically to FIG. 5, the plunger member 16 includes a hollow elongate shaft 20 having a distal end 22 and a proximal end 24, and preferably made from material such as, but not limited to, steel. The plunger member 16 further includes cylindrical member 26 disposed on the hollow elongate shaft 20, and further includes a plurality of hydraulically activated pins 28, which as will be explained, can pierce through the cylindrical wall of the pipe riser 18 when inserted therein. The plurality of outwardly extending pins 28 are designed to hydraulically extend outwardly and pierce though the rise oil pipe and extend outwardly, thereby providing a greater securing holding measures of the plunger member 16 inside the oil pipe riser 18.

The plunger member 16 further includes conical member 30 attached to the proximal end 24, and positioned above the conical member 30 on the hollow elongate shaft 20 are a first inflatable ring bag 32, a frusto-conical inflatable member 34, a second inflatable ring bag 36, a second frusto-conical inflatable member 38 having a plurality of seal rings 40 on an outer periphery thereof, and a third inflatable ring bag 42 operable placed along the elongate shaft 28. The inflatable members are preferably made from, for example, but not limited to, Kevlar®, and are inflatable through an air or through a hydraulic fluid inlet extending along the length of the hollow elongate shaft 20. As will be explained in greater detail, when the plunger member 16 is inserted through the oil well pipe riser 18, the inflatable members expand to the desired width corresponding to the diameter of the pipe riser 18 thereby providing a seal between the inner surface of the pipe riser 18 and the outer surface of the plurality of inflatable members.

Figure 2:
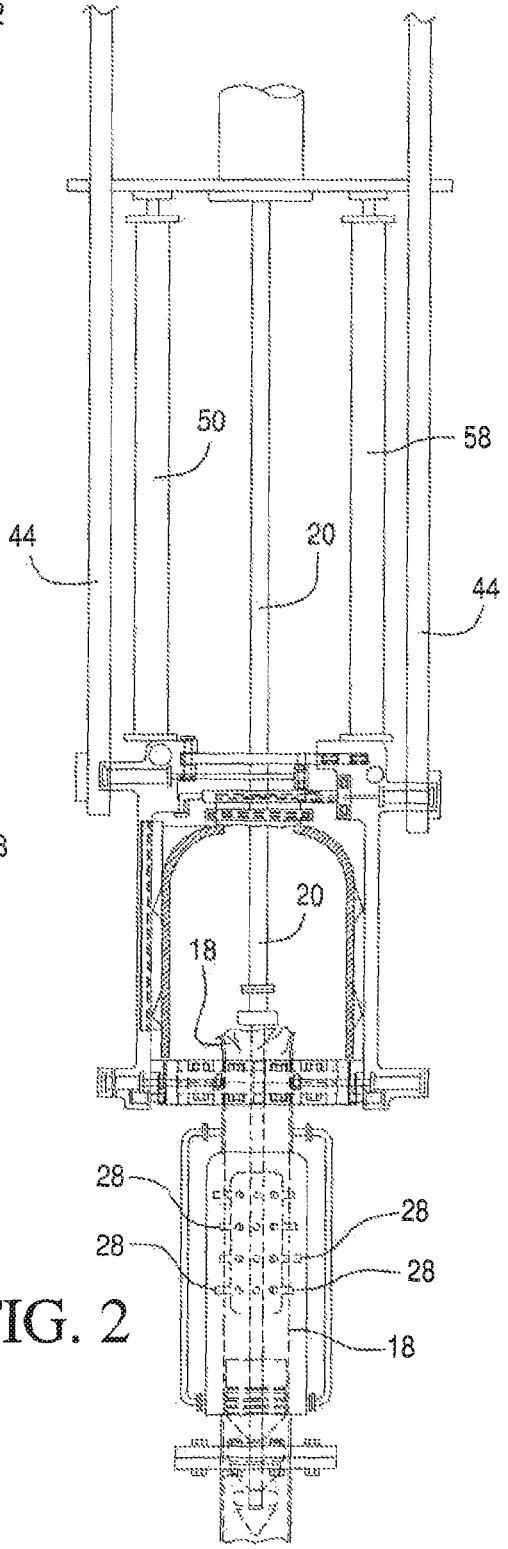
FIG. 2 is a partly side elevation and partly side sectional view of the oil well plug apparatus in a well bore sealing position inserted into the riser of FIG. 1.
Figure 3:
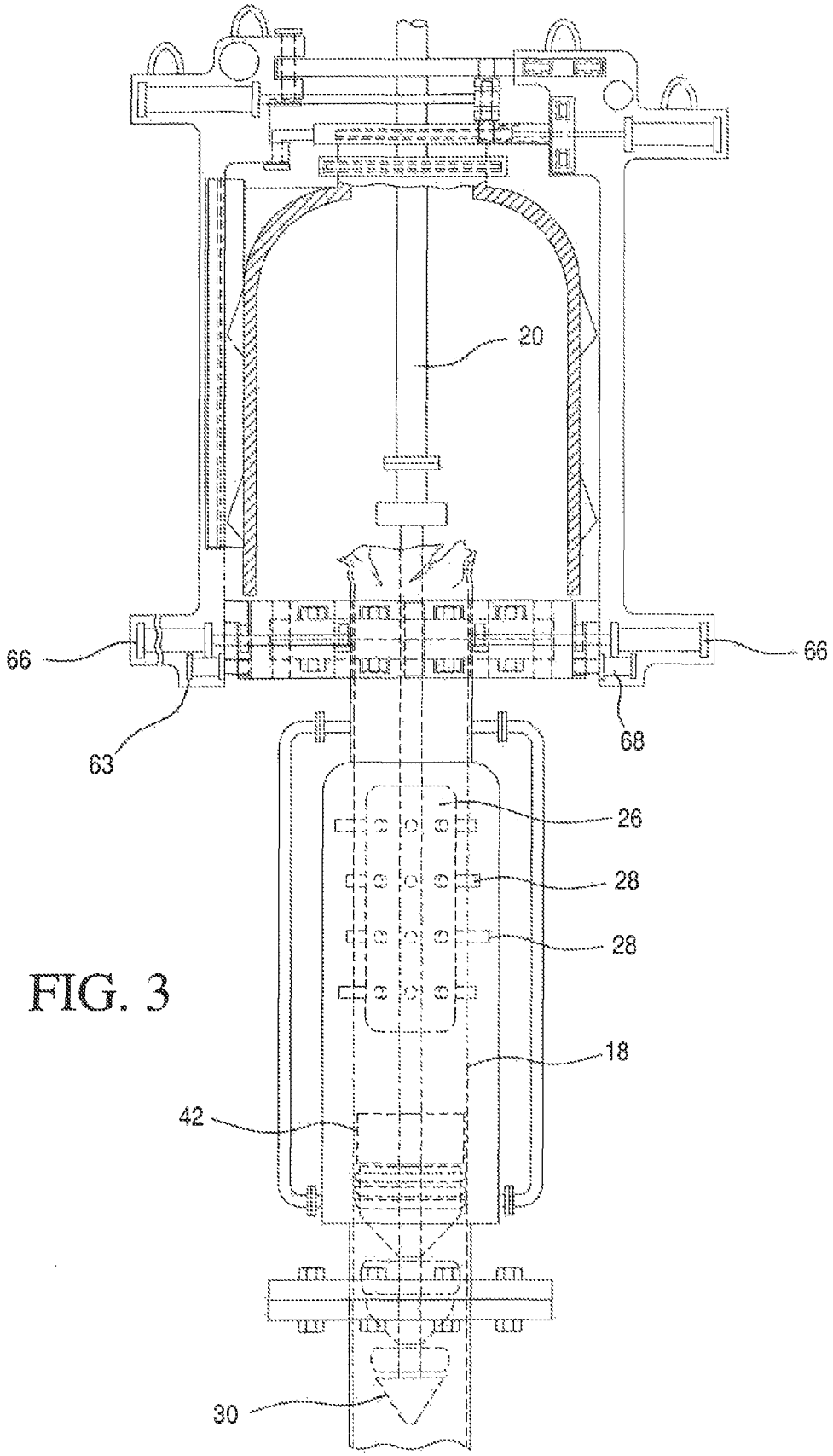
FIG. 3 is a partly side elevation and partly side sectional view of the oil well plug apparatus of FIG. 2 in enlarged form illustrating the details thereof.
Figure 4:
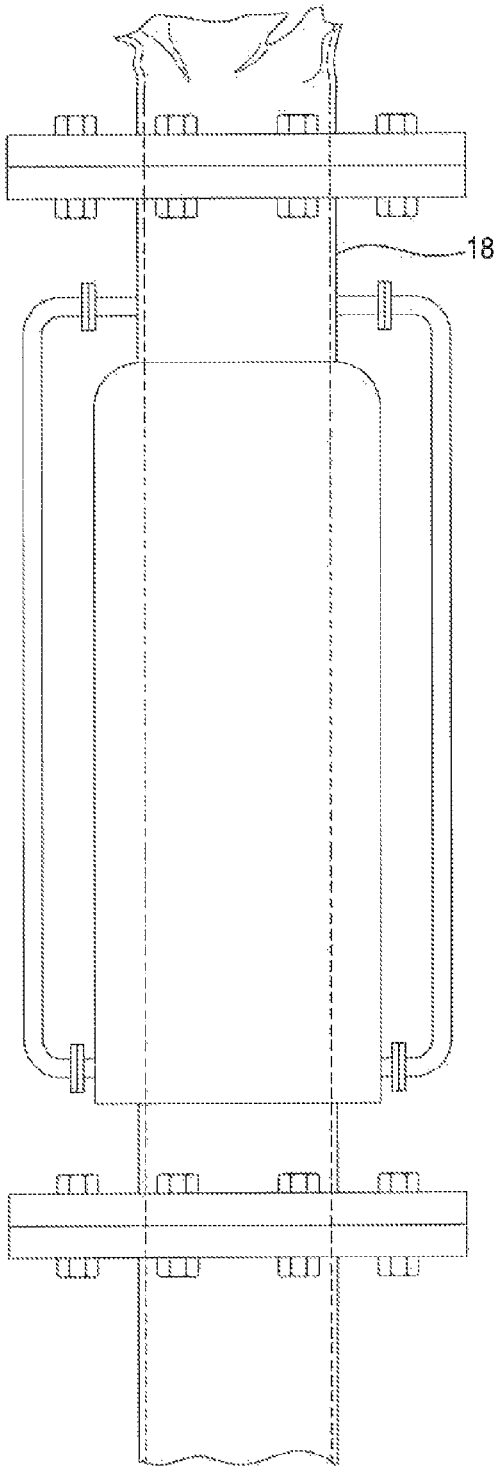
FIG. 4 is a side elevation of an oil pipe riser.

Referring more specifically back to FIGS. 1 and 2, the plunger member 16 is movably and slidably supported in a vertical direction by a frame having a pair of stabilizing vertical bars 44, the first of the pair of stabilizing vertical bars 44 is attached to the first main frame 12 at a first end 46, and the second of the pair of stabilizing vertical bars 44 is attached to the second main frame 14 at a first end 48. A first vertical hydraulic arm 50 has a first end 52 attached to the first main frame 12 and a second end 54 attached to a stabilizer plate 56, and a second vertical hydraulic arm 58 has a first end 60 attached to the second main frame 14 and a second end attached to the stabilizer plate 56. The stabilizer plate 56 also centrally supports the hollow elongate shaft 20, thereby pushing down the first and the second vertical hydraulic arms 50, 54, consequently pushes down the plunger member 16 as a result of hollow elongate shaft 20 being pushed down. The hollow elongate shaft may be comprised of two separate shafts attached to one another with a coupling means 64, which as will be described in greater detail herein, may allow the upper part of the shaft to separate from the lower part of the shaft in one embodiment use of the invention.

In order to lower the plunger member 16 inside the pipe riser 18, the first main frame 12 and the second main frame 14 have to be secured around the oil well pipe riser 18. The first and the second main frames 12, 14, in a closed and secured configuration, create a shell that conforms to the shape and configuration of the ultimate resulting concrete casing. The lower part of the first and second main frames 12, 14 is secured around the pipe riser 18 opening with a pair of first hydraulic arms 66 and a pair of second hydraulic arms 68 arranged in a diametrically opposed configuration and each are pivotally attached to the lower frame with respective support links 70 at opposing pivot points 72. Each of the pair of first hydraulic arm 66 include an interlocking claw 74, which as will be explained in greater detail, engage (lock) and disengage (unlock) with a corresponding pair of interlocking claws 76 each pivotally mounted and operable by the pair of second arms 68.

Figure 6:
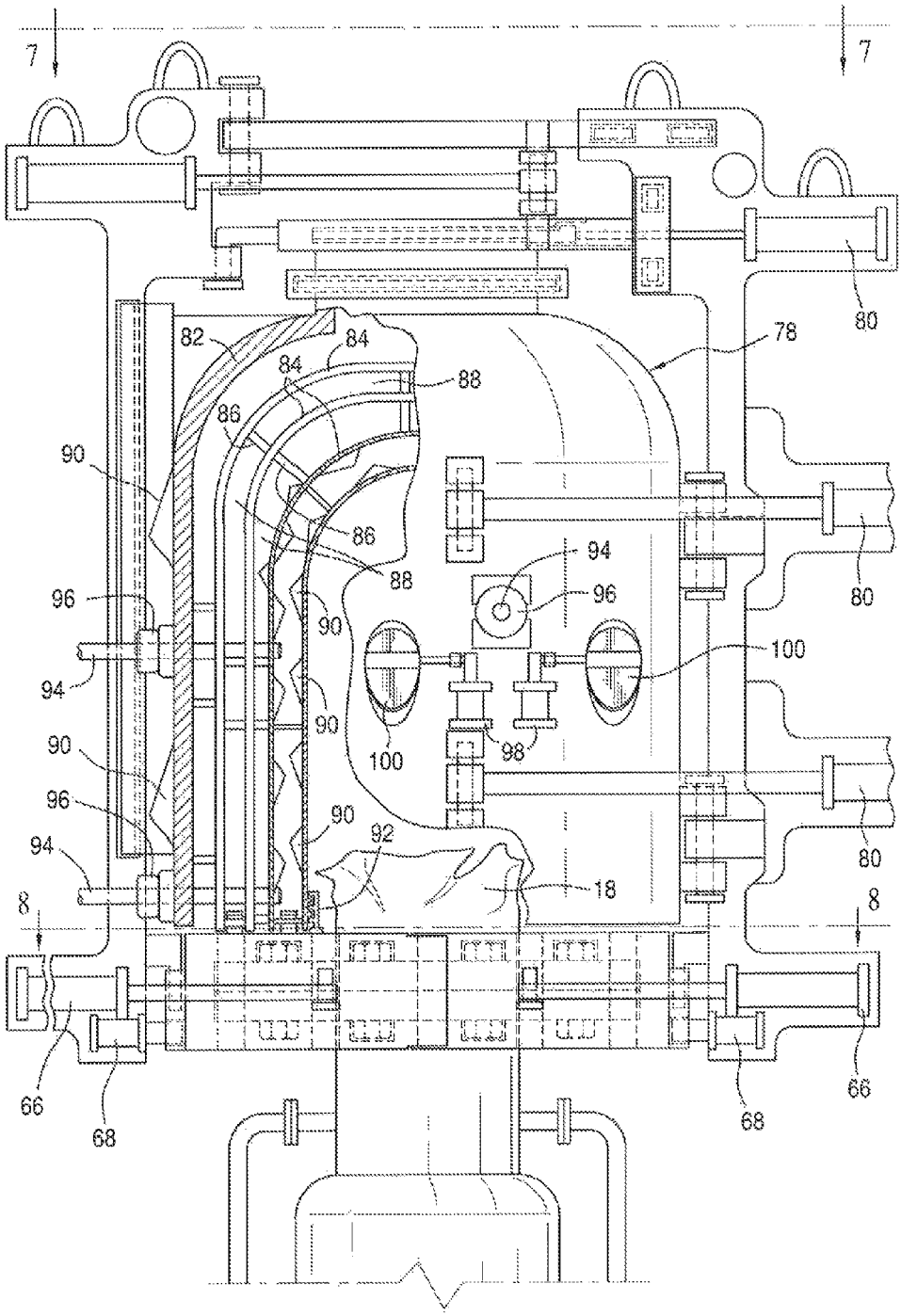
FIG. 6 is a side sectional view of the bell-shaped outer chamber of the oil well plug apparatus of FIG. 1.
Figure 8:
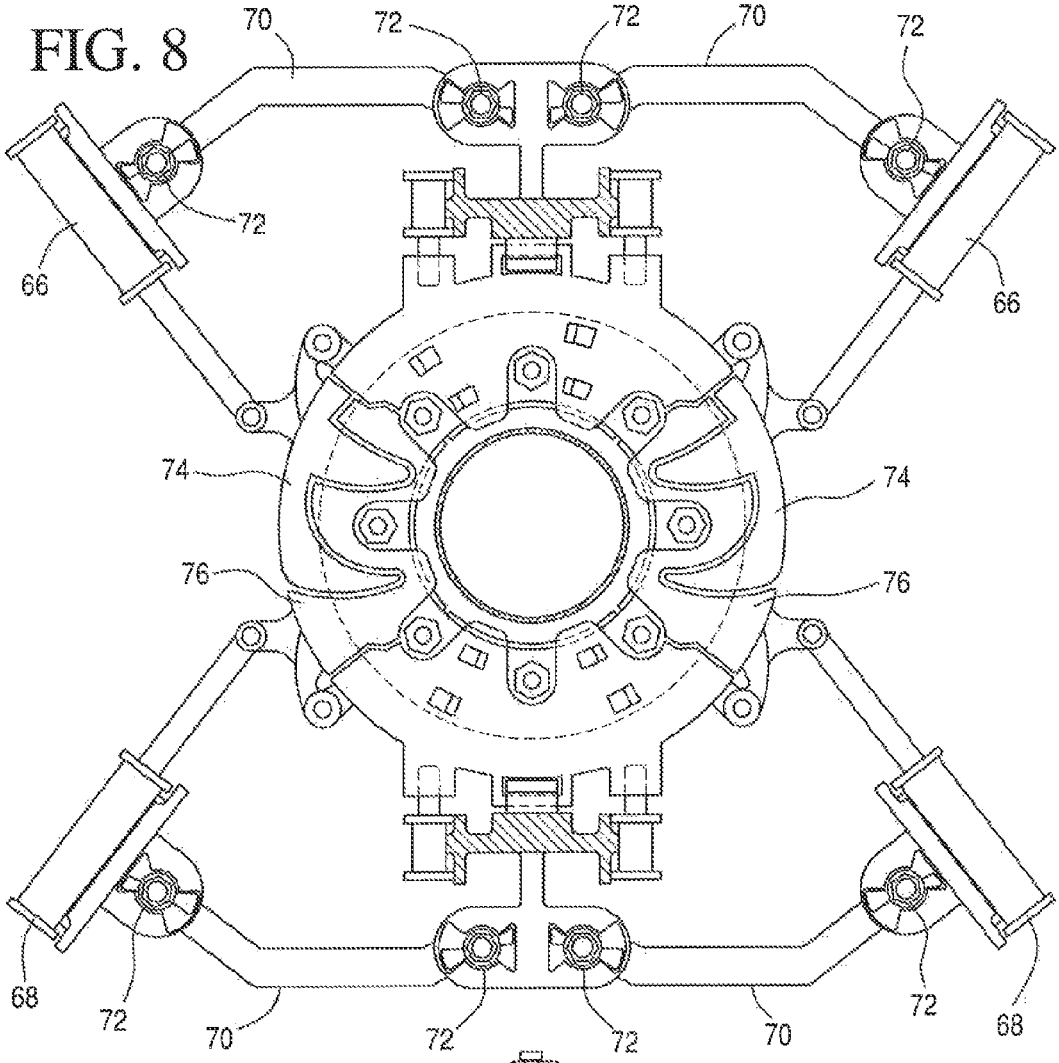
FIG. 8 is a cross-sectional view of the oil well plug apparatus of FIG. 6 taken along the line 8-8.
Figure 7:
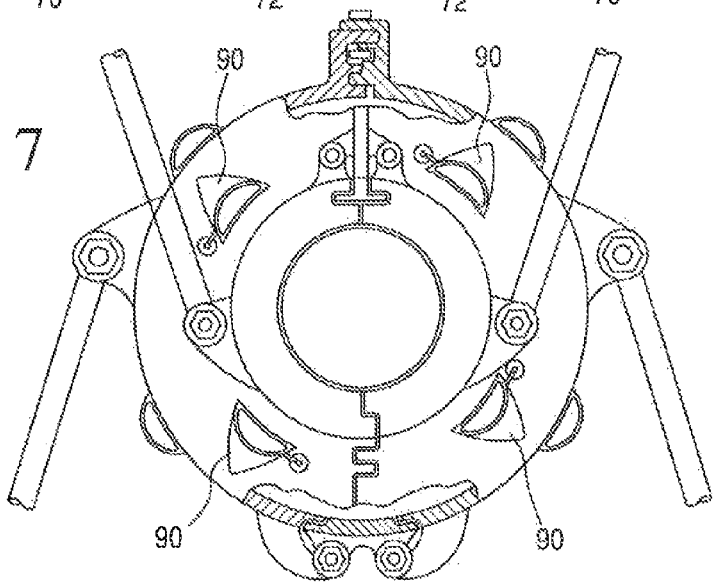
FIG. 7 is a cross-sectional view of the oil well plug apparatus of FIG. 6 taken along the line 7-7.
Figure 9:
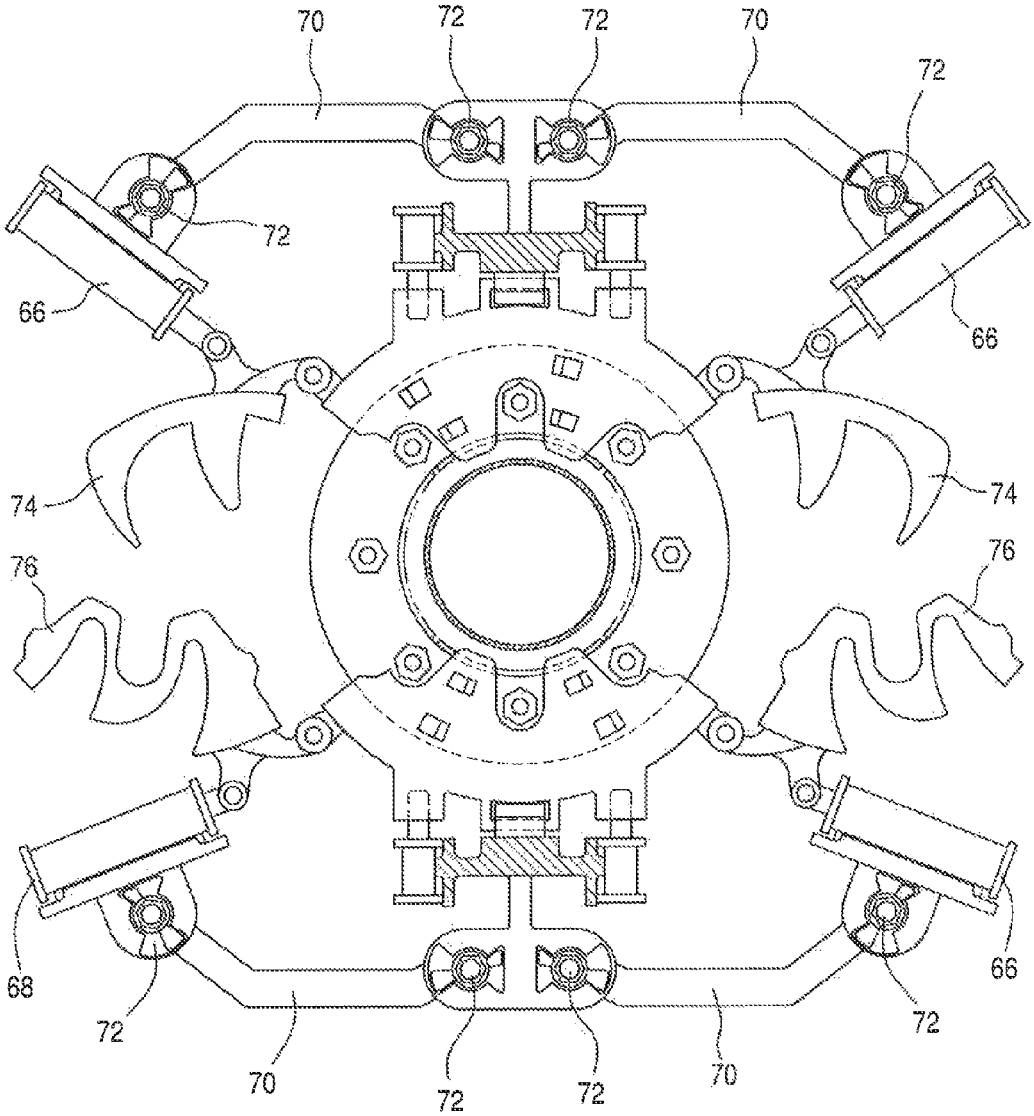
FIG. 9 is a top plan view of the oil well plug apparatus shown in FIG. 6 in an open position not yet attached to the oil well riser.
Figure 10:
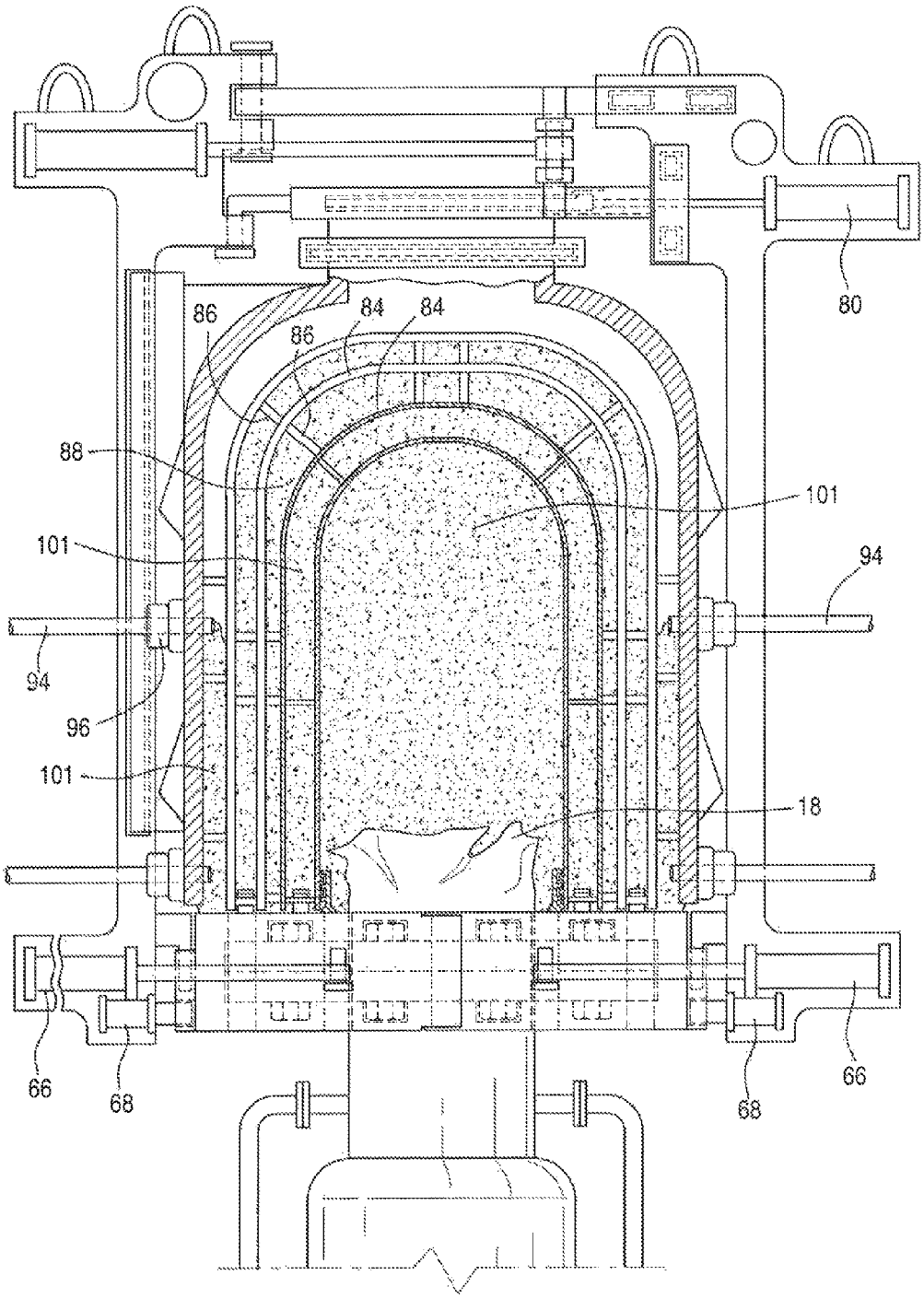
FIG. 10 a side sectional view of the oil well plug apparatus with the bell-shaped outer chamber filled with concrete or other sealing material at a final stage of the sealing and abandoning the oil well; and, FIG. 11 a side sectional view of the oil well plug apparatus removed from the leaking oil well site and the final concrete bell-shaped chamber cured on top of the oil well leak permanently plugging the oil well and abandoning the oil well.

Referring more specifically to FIG. 6, the oil plug apparatus 10 further comprises a bell-shaped chamber or cap 78, preferably made from material such as, but not limited to, steel or other similar material, and comprises a plurality of shells and layers which will be filled with cured and set to dry material such as, but not limited to, micro concrete, heavy liquid rubber, or composites with silicone based material as will be explained in greater detail herein. Another set of plurality of hydraulic arms 80 is secured to the outer shell 82 of the bell-shaped chamber 78 to provide for securing the bell-shaped chamber in place for the initial slow down or stoppage of the oil flow, and then consequent filling of the concrete material therewithin.

The bell-shaped chamber 78 further includes a plurality of inner shells 84 separated from one another with a plurality of distant spacers 86 creating an interconnecting chambers 88 therebetween, which the interconnecting chambers 88 are fluidly connected to one another with a plurality of release exhausts or vents 90. A holder mechanism 92 is arranged and configured to hold the bell-shaped chamber 78 on top of the oil well pipe riser 18. A plurality of supply lines 94, for supplying the concrete or other suitable material as discussed above, are provided from the outside of the bell-shaped chamber 78 through the outer shell 82 and extending through the plurality of shells 84 and each sealed with sealing rubber washer 96 or similar components to prevent the leaking the oil or the curing concrete from the bell-shaped chamber 78. A plurality of hydraulic shutter valves 98 and a plurality of vent valves 100 are also operably provided, which, as will be explained in greater detail, provide for the curing process of the concrete or suitable filling material.

There are several methods of containing the oil flow gushing out of a damaged oil well pipe, which are explained herein. It is understood that these methods contemplate various combinations of the using the plunger member 16 and the bell-shaped chamber 78 independently on their own or together using the plunger member 16 first and the bell-shaped chamber 78 second. However, the use of each method and related apparatus remains the same in view of the combinations used.

The first method requires the use of the plunger member 16 and insertion thereof within the oil pipe rise 18. The pair of first hydraulic arms 66 and the pair of second hydraulic arms 68 are used to engage the interlocking claws 74, 76, to secure the first main frame 12 and the second main frame 14 to the oil pipe riser 18. Then, the first and second vertical hydraulic arms 50, 58 are activated to lower the hollow elongate shaft 20 and cylindrical member 26 through the oil pipe riser 18. Next, hydraulically activated pins 28 are outwardly activated and extended to pierce through the oil pipe riser 18 and thereby securing the plunger member 16 within the oil pipe riser 18 preventing it from being pushed upwardly out of the pipe riser 18. Then, the frusto-conical inflatable member 34, second inflatable ring bag 36, second frusto-conical inflatable member 38, seal rings 40, and third inflatable ring bag 42 are inflated to engage the inner wall of the pipe riser 18 to act as a sealing mechanism preventing the oil leaking substantially or completely out. If the oil pressure gushing out is of the pressure that the plunger member 16 and the inflatable members can completely seal and prevent it from gushing out through this first method, then the second step and method of using the bell-shaped chamber 78 may not be necessary. Otherwise, if the plunger member 16 cannot prevent and kill the oil flow gushing out completely, then the use of the bell-shaped chamber is necessary as the next step to create a permanent cement or the like cap on the oil well and permanently shutting the oil well from operation.

Figure 11:
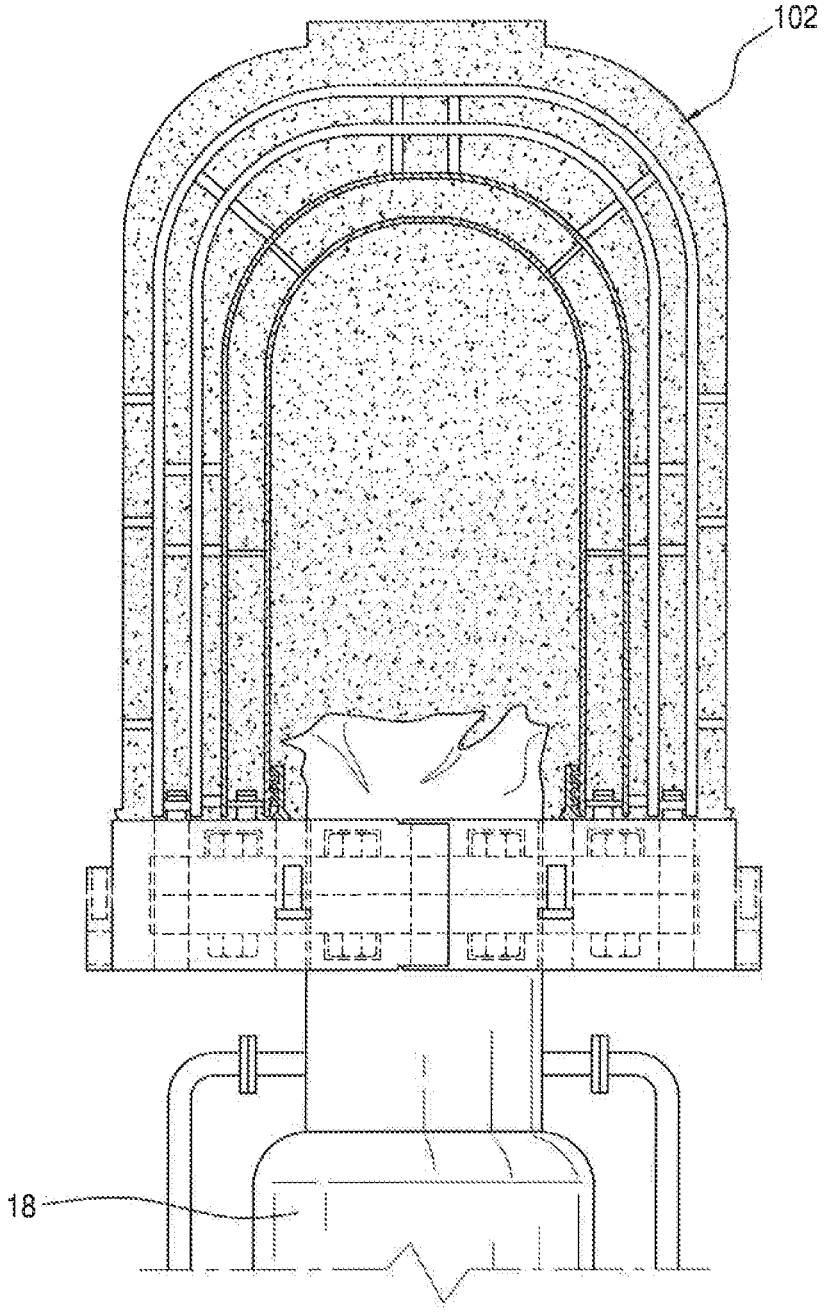

This second method of using the bell-shaped chamber 78 is as follows. The oil flow pressure through the shells 84 and interconnecting chambers 88 is substantially reduced and slowed down as the oil flows through the plurality of release exhausts or valves 90 and flows through the interconnecting chambers 88. Then a top main valve is closed and the bell-shaped chamber is ready to be filled with concrete. Next, the micro concrete 101 or heavy liquid rubber is pumped within the interconnecting chambers 88 through the supply lines 94, and concrete 101 flows within the chambers through release exhausts 90 until every single one of the interlocking chambers 88 is filled with the concrete 101 thereby forming in the shape of the bell-shaped chamber 78 having multiple layers. Then the concrete 101 is fully cured, and the curing process is controlled using the hydraulic shutter valves 98 and the vent valves 100. After the concrete is fully cured, the hydraulic arms are released and bell-shaped chamber 78 is removed and bell-shaped permanent concrete cap 102 is created on top of the oil well riser 18 and sealing the oil well permanently, as been seen in FIG. 11.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto. While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

What is claimed is:

1. A deep-water oil well bore plug and sealing mechanism, comprising:

a plunger having an elongate shaft and a plurality of inflatable washers along a length thereof; and wherein the plunger further comprises a cylindrical member at an end of said elongate shaft; and a hydraulic arm for lowering said plunger and inserting a plug at an end thereof inside the well bore;

a bell-shaped chamber having a plurality of concentric inner shells about a vertical axis and on the same horizontal plane secured on top of said well bore using a plurality of hydraulic arms interlocking with one another, and wherein said inner shells are separated from one another with a plurality of distant spacers creating interconnecting chambers therebetween, and in which interconnecting chambers are fluidly connected to one another with a plurality of release exhausts or vents;

means for filling the plurality of shells with curable material;

wherein said bell-shaped chamber is removed after said curable material is set and cured; and wherein said cylindrical member further comprises a plurality of hydraulically and outwardly extending pings for piercing through the outer wall of an oil pipe riser.

2. The deep-water oil well bore plug and sealing mechanism of claim 1, wherein said plurality of shells are interconnected with one another through a plurality of vents.

3. The deep-water oil well bore plug and sealing mechanism of claim 1, wherein said means for filling said plurality of shells with curable material is a plurality of supply lines.

4. The deep-water oil well bore plug and sealing mechanism of claim 1, wherein said curable material is concrete.

5. A method of sealing and plugging a deep-water oil well pipe, comprising the steps of:

providing a hydraulic arm and mechanism;

lowering a plunger having an elongate shaft and a plurality of inflatable washers along a length thereof through an oil well pipe riser using said hydraulic arm and mechanism;

providing a bell-shaped chamber having a plurality of concentric inner shells about a vertical axis and on the same horizontal plane secured on top of said oil pipe riser using a plurality of hydraulic arms interlocking said hydraulic arms with one another;

filling the plurality of shells with curable material; and removing said bell-shaped chamber after said curable material is set and cured.

* * * * *